US007060916B1

(12) United States Patent
Amit et al.

(10) Patent No.: US 7,060,916 B1
(45) Date of Patent: Jun. 13, 2006

(54) KNOB DESIGN FOR A ROTARY ENCODER

(75) Inventors: Gad Amit, Belmont, CA (US); Joshua T. Morenstein, San Francisco, CA (US); Robin Parnaby, San Francisco, CA (US); David W. Anthony, San Francisco, CA (US); Matthew Cho, San Francisco, CA (US)

(73) Assignee: Avid Technology, Inc., Tewksbury, MA (US)

( * ) Notice: Subject to any disclaimer, the term of this patent is extended or adjusted under 35 U.S.C. 154(b) by 0 days.

(21) Appl. No.: 11/301,802

(22) Filed: Dec. 13, 2005

Related U.S. Application Data

(63) Continuation of application No. 11/105,948, filed on Apr. 14, 2005.

(51) Int. Cl.
*H01H 19/58* (2006.01)

(52) U.S. Cl. ..... 200/11 R; 200/4

(58) Field of Classification Search ..... 200/4, 200/17 R, 18, 292, 293, 336, 564
See application file for complete search history.

(56) References Cited

U.S. PATENT DOCUMENTS

| | | | | |
|---|---|---|---|---|
| 6,674,026 | B1 * | 1/2004 | McGrath et al. | 200/4 |
| 2005/0173232 | A1 * | 8/2005 | Horton et al. | 200/11 R |
| 2005/0284737 | A1 * | 12/2005 | Shitanaka et al. | 200/5 R |

* cited by examiner

*Primary Examiner*—Michael Friedhofer
*Assistant Examiner*—Lisa Klaus
(74) *Attorney, Agent, or Firm*—Peter J. Gordon

(57) ABSTRACT

A rotary encoder of a control surface has a display. The display includes a ring of light emitting elements, such as light emitting diodes (LEDs), in the control surface around the shaft and knob of the rotary encoder. The rotary encoder has a shaft that rotates about an axis under control of an operator. The rotary encode has an output providing a signal indicative of the rotational movement of the shaft. A knob engages the shaft and is used by the operator to rotate the shaft. The knob, in general, has a narrow stem that engages the shaft of the rotary encoder and extends away from the control surface, and a top portion which the operator manipulates to turn the knob. The stem has a substantially circular cross-section, in a plane perpendicular to the axis of the shaft of the rotary encoder, with a narrow diameter. Similarly, the top portion has a substantially circular cross-section, in a plane perpendicular to the axis of the shaft of the rotary encoder, with a diameter larger than the diameter of the shaft cross-section. The narrow stem may have a cylindrical shape. The top portion may have a spherical shape and may be substantially rotationally symmetrical in a plane perpendicular to its axis, i.e., when viewed from the top. The knob and the shaft may be metalized to provide touch sensitivity. The top portion may include a rubber insert that protrudes around its circumference. The narrow diameter of the stem minimizes the obstruction of the view of the ring of light emitting elements. The size and texture of the top portion of the knob provides a good grip, feel and tactile response for the operator.

34 Claims, 4 Drawing Sheets

KNOB DESIGN FOR A ROTARY ENCODER

CROSS-REFERENCE TO RELATED APPLICATION

This application is a continuation of and claims the benefit of priority of U.S. application Ser. No. 11/105,948, filed on Apr. 14, 2005, pending.

BACKGROUND

Control surfaces for a variety of audio processing systems, such as audio mixers, consoles and digital audio workstations, typically include numerous control devices and associated status displays. Example control devices include linear faders, rotary encoders, joysticks, touch pads and push buttons. Example status displays include LED arrays, alphanumeric displays and graphical displays. Sometimes the control device is motorized. In such a case, motion of the control device under control of a motor also functions as a status display.

Some control devices include embedded status displays, such as LED arrays in the tops of knobs or pushbuttons. By embedding a status display within the control device, the control device does not obstruct the view of the status display. However, the complexity of the control device is increased. Also, an operator normally does not have a full top view of a console surface which would enable the operator to see all of the status displays associated with all of the control devices. In actuality, many of the control devices on the control surface are viewed at an angle. Thus, the structure of the control device can obscure the view of embedded status displays.

SUMMARY

A rotary encoder of a control surface has a display. The display includes a ring of light emitting elements, such as light emitting diodes (LEDs), in the control surface around the shaft and knob of the rotary encoder. The rotary encoder has a shaft that rotates about an axis under control of an operator. The rotary encode has an output providing a signal indicative of the rotational movement of the shaft. A knob engages the shaft and is used by the operator to rotate the shaft. The knob, in general, has a narrow stem that engages the shaft of the rotary encoder and extends away from the control surface, and a top portion which the operator manipulates to turn the knob. The stem has a substantially circular cross-section, in a plane perpendicular to the axis of the shaft of the rotary encoder, with a narrow diameter. Similarly, the top portion has a substantially circular cross-section, in a plane perpendicular to the axis of the shaft of the rotary encoder, with a diameter larger than the diameter of the shaft cross-section. The narrow stem may have a cylindrical shape. The top portion may have a spherical shape and may be substantially rotationally symmetrical in a plane perpendicular to its axis, i.e., when viewed from the top. The knob and the shaft may be metalized to provide touch sensitivity. The top portion may include a rubber insert that protrudes around its circumference. The narrow diameter of the stem minimizes the obstruction of the view of the ring of light emitting elements. The size and texture of the top portion of the knob provides a good grip, feel and tactile response for the operator.

DETAILED DESCRIPTION

Figure 1:
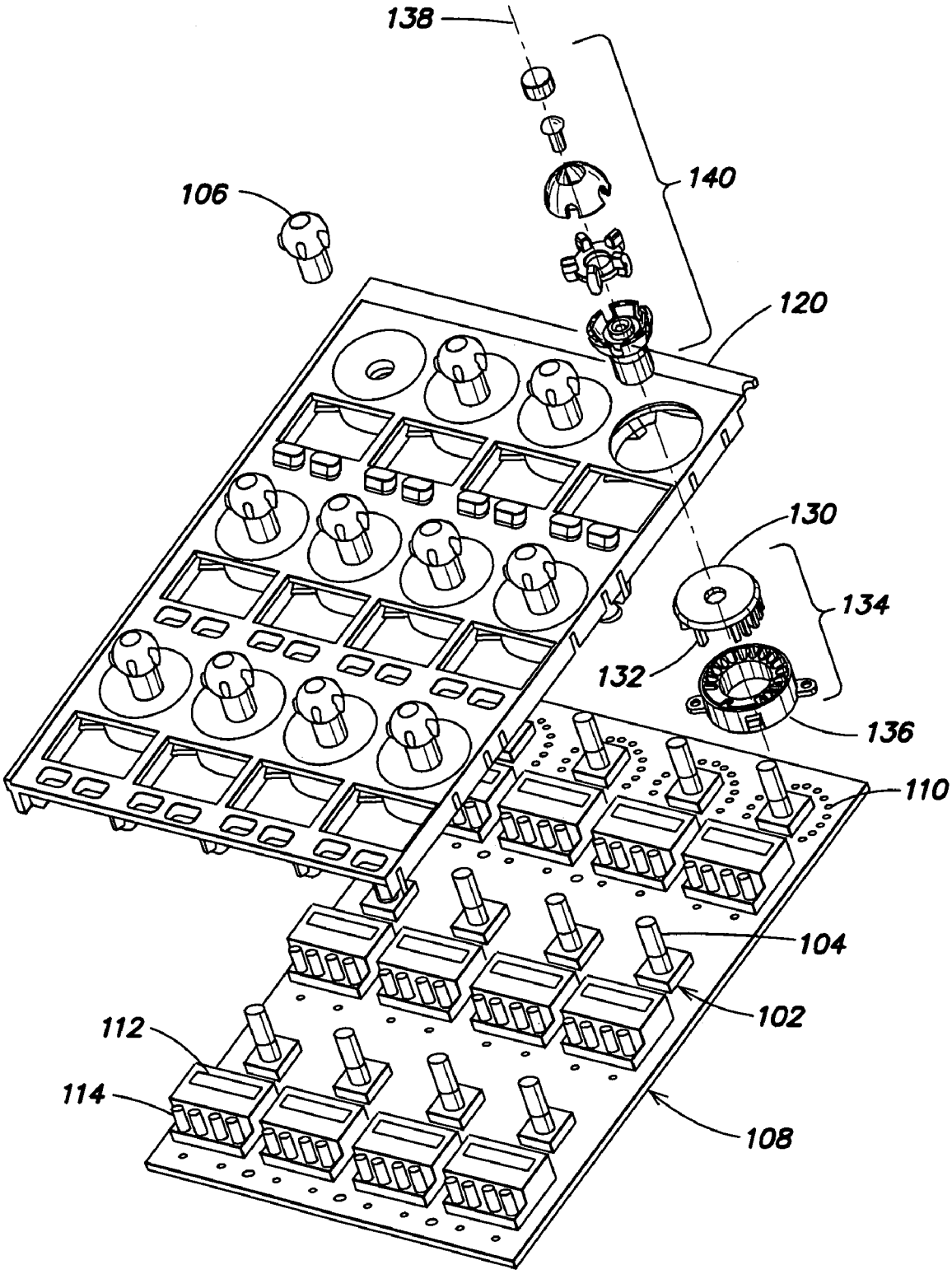
FIG. 1 is an exploded perspective view of part of a control surface that includes a set of rotary encoders and corresponding ring of light emitting elements.

Referring now to FIG. 1, an example component of control surface will now be described. This component includes multiple rotary encoders 102. Each rotary encoder has a shaft 104 onto which a knob 106 is mounted. Each rotary encoder is an electronic device that is mounted in on a printed circuit board 108. The shaft of the rotary encoder rotates around an axis 138 under control of an operator. The rotary encoder has an output providing a signal indicative of the rotational movement of the shaft. The operation of the rotary encoder may be electrical, optical, electromechanical or electro-optical, and includes rotary potentiometers.

The printed circuit board also includes, for each rotary encoder, a ring of light emitting elements 110. A display assembly 134, for which an example construction is described in more detail below in connection with FIG. 4, includes a set of light pipes 132 placed above the ring of light emitting elements. The light pipes are connected to a display 130 and are placed within a shroud 136. The display assembly is mounted over the ring of light emitting elements 110 and is attached to the printed circuit board 108. Each rotary encoder also may have a corresponding display 112, such as an alphanumeric display, and pushbuttons 114. These devices also are attached to the printed circuit board.

One or more of such printed circuit boards may be present in the control surface. Each printed circuit board is connected to and in communication with a controller (not shown). The controller transmits information, such as settings from pushbuttons and rotary encoders, to another device such as a host computer. The controller also receives status information from other devices, such as the host computer. Such status information may be used, for example, to set the state of the ring of light emitting elements and the alphanumeric display.

The electromechanical components on the printed circuit board in FIG. 1 are covered by a surface portion 120. The surface portion has holes that surround the display 130 for each rotary encoder 102. The surface portion 120 also has either holes or transparent portions that permit the alphanumeric displays to be viewed. Holes also are provided through which push button covers connect to pushbuttons on the printed circuit board. A knob assembly 140, as described in more detail below in connection with FIGS. 2 and 3, forms a knob 106 that connects to a shaft of a rotary encoder.

The knob, in general, has a narrow stem that engages the shaft of the rotary encoder and extends away from the control surface, and a top portion which the operator manipulates to turn the knob. The stem has a substantially circular cross-section, in a plane perpendicular to the axis of the shaft of the rotary encoder, with a narrow diameter. Similarly, the top portion has a substantially circular cross-section, in a plane perpendicular to the axis of the shaft of the rotary encoder, with a diameter larger than the diameter of the shaft cross-section. The narrow stem may have a cylindrical shape. The top portion may have a spherical shape and may be substantially rotationally symmetrical. The narrow diameter of the stem minimizes the obstruction of the view of the ring of light emitting elements. The size and texture of the top portion of the knob provides a good grip, feel and tactile response for the operator.

Figure 2:
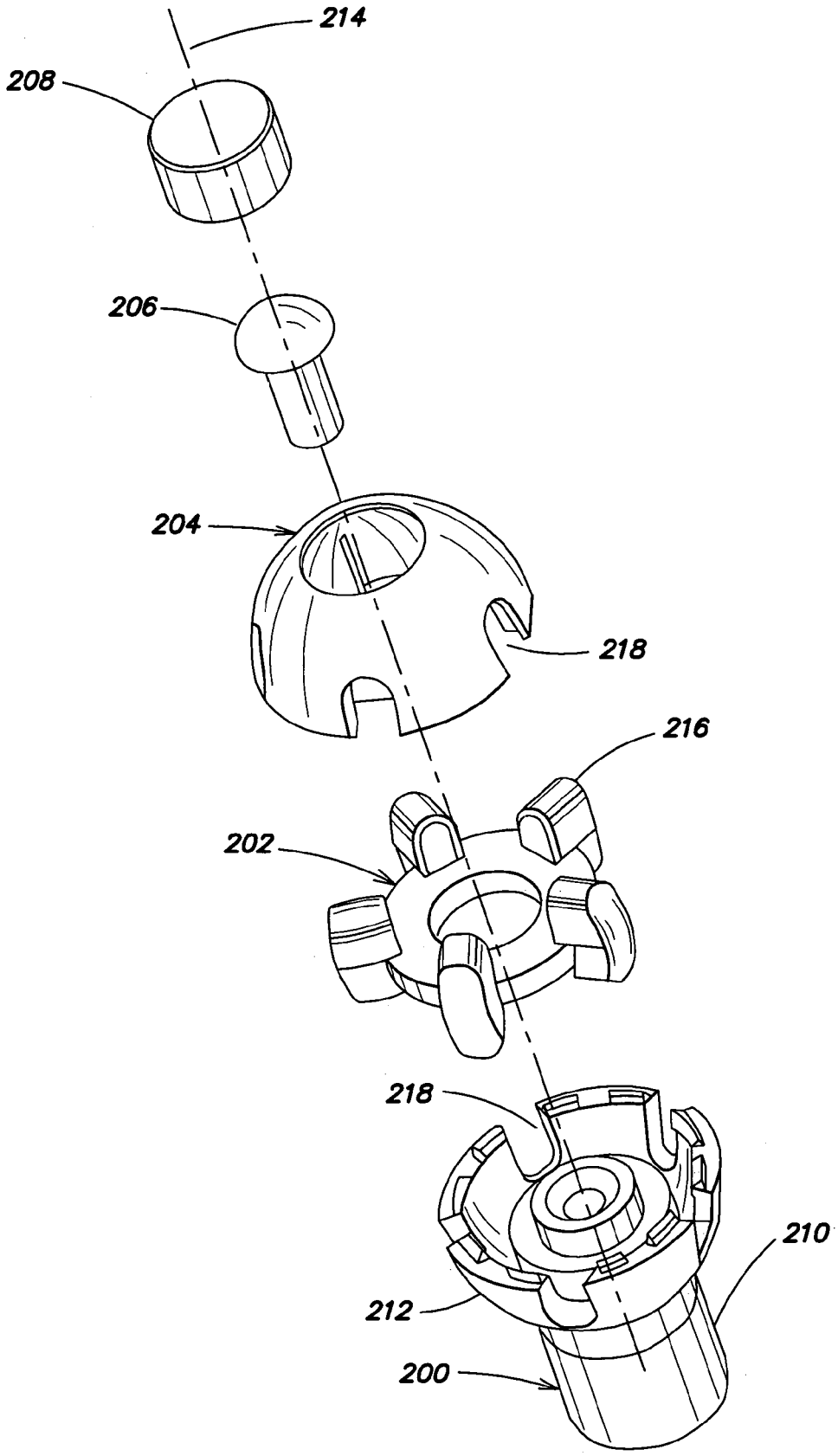
FIG. 2 is an exploded perspective view of an example construction of an example knob.

Referring now to FIG. 2, an example construction for the knob (knob assembly 140 in FIG. 1) will now be described. This knob assembly has an axis 214 about which it rotates. When mounted on the shaft of a rotary encoder, the axis 214 of the knob is collinear with the axis of the shaft. In this example construction, a knob includes a knob base 200, a knob insert 202, knob top 204, a screw 206 and a knob cap 208. The knob base 200 has a narrow stem 210 having a recess for engaging the shaft of the rotary encoder. When attached to the shaft of the rotary encoder, the stem extends away from the control surface. This stem 210 may be cylindrical in shape and has a diameter in a plane perpendicular to the axis 214. The knob base 200 also includes a top portion 212. This top portion may be hemispherical in shape. The top portion 212 of the knob base 200 engages with a knob top 204. The knob top 204 also may be hemispherical in shape. When the knob top and knob base are connected, they form a knob with a substantially spherical top portion. The diameter of this spherical top portion, for a cross section in a plane perpendicular to the axis 214, is larger than the diameter of the stem 210 of the knob base. At its largest diameter, the diameter of the top portion is larger than the largest diameter of the cylindrical portion.

An appropriate fastener, such as a screw, may be used to connect the knob top to the knob base. The knob cap 208 with an interference fit with the knob top 204 may be used to hide such a fastener. The knob top 204 and knob base 200 can be connected using any of a variety of fastening mechanisms and the invention is not limited thereby. The knob base 200 and knob top 204 can be made of injection-molded, metalized plastic. In combination with a conductive shaft for the rotary encoder, the rotary encoder may be made touch-sensitive.

A knob insert 202 made of, for example, neoprene, may be provided between the knob top 204 and knob base 200. This knob insert has protrusions 216 that extend out of the knob assembly through apertures 218 in the knob top and knob base. The knob insert provides a good grip, feel and tactile response to the operator.

Except for the knob insert 202, the top portion of the knob assembly is substantially rotationally symmetrical in a plane perpendicular to its axis 214, i.e., when viewed from the top. The narrow diameter of the stem minimizes the obstruction of the view of the ring of light emitting elements. The size and texture of the top portion of the knob provides a good grip, feel and tactile response for the operator.

Figure 3:
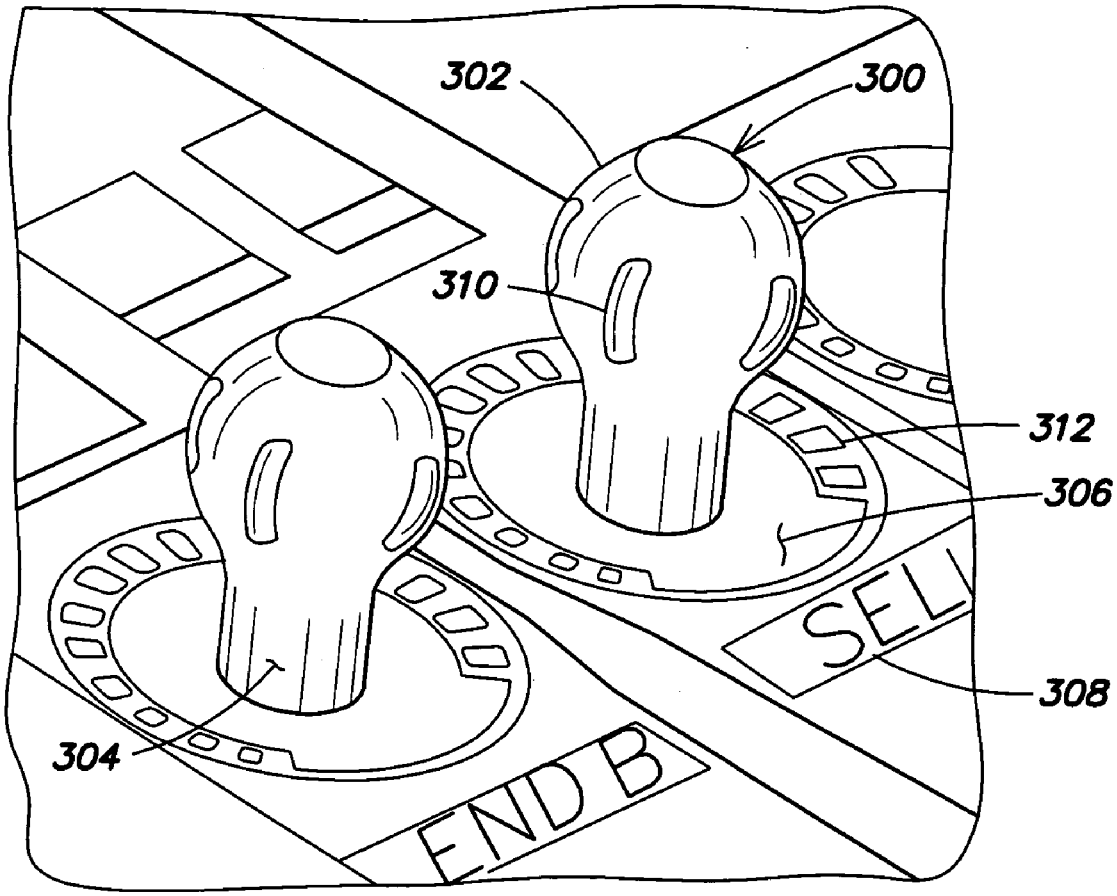
FIG. 3 is a perspective view of part of an example control surface.

FIG. 3 illustrates a close-up, perspective view of two assembled knobs and their associated displays. In particular, a knob 300 has a stem 304 and a top portion 302. The knob inserts are shown at 310. A dish-shaped display 306 surrounds the knob 300. A ring of light emitting elements underneath the display 306 illuminate the display surface at points such as 312. An associated alphanumeric display 308 also is provided.

Figure 4:
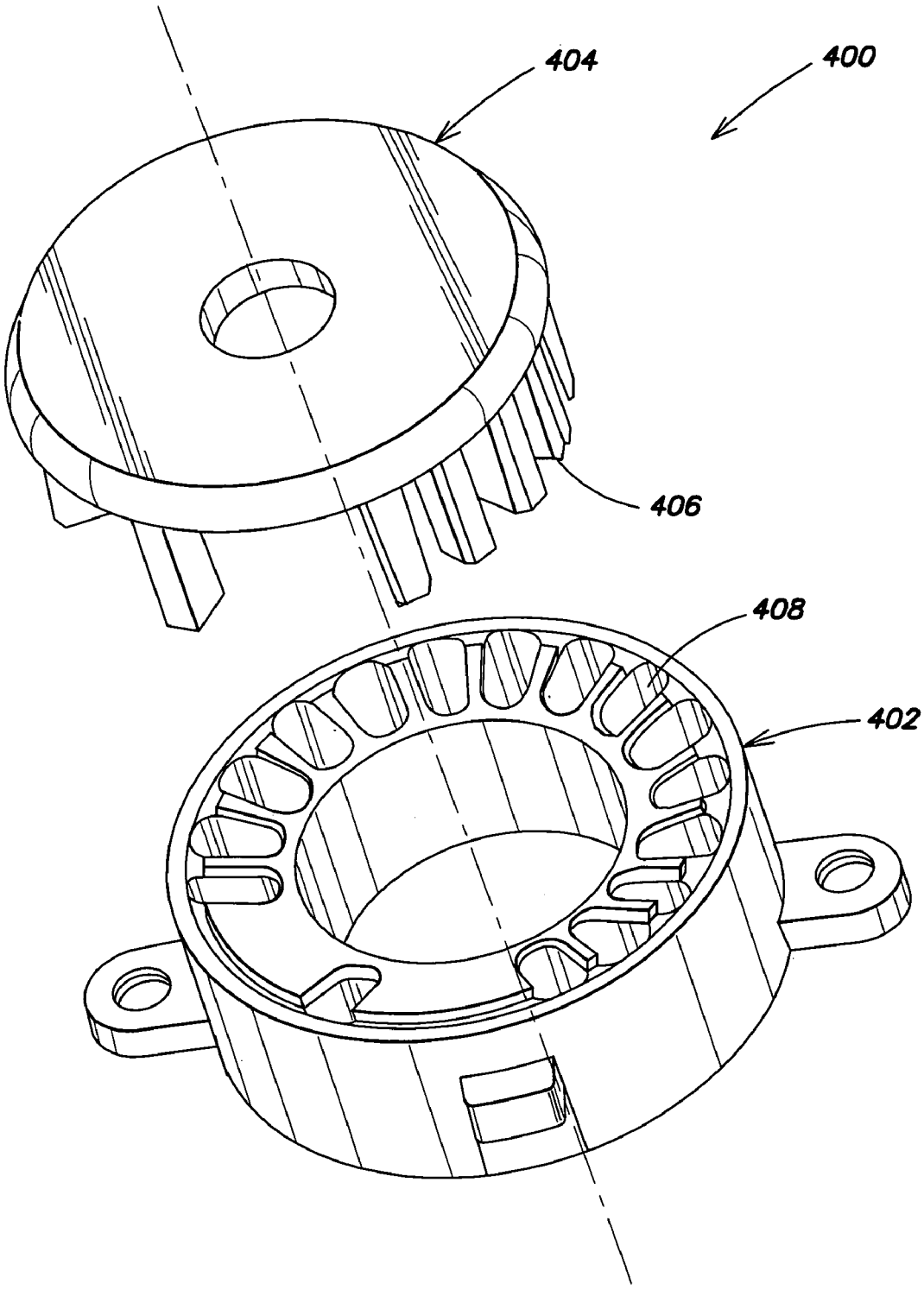
FIG. 4 is an exploded perspective view of an example construction of an example display.

FIG. 4 illustrates in more detail a dish-shaped display 400 (an example construction of the display 130 of FIG. 1 and display 306 in FIG. 3). The display 400 includes a plastic shroud 402 that attaches to the printed circuit board. A set of light pipes 406 are connected to a dish-shaped cover 404. Each light pipe is inserted into a corresponding cavity 408 in the plastic shroud. The plastic shroud 402 blocks light from one light pipe from bleeding into an adjacent light pipe.

Such a knob may be used for rotary encoders of a variety of types, and is particularly useful for control surfaces of audio processing systems. In such systems, a large number of such rotary encoders and associated displays are used.

Having now described an example embodiment, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention.

What is claimed is:

1. A knob for a rotary encoder having a shaft and an output providing a signal indicative of rotational movement of the shaft on an axis, comprising:

a stem that engages the shaft of the rotary encoder and extends away from a control surface, and a top portion which an operator manipulates to turn the knob;

wherein the stem has a substantially circular cross-section, in a plane perpendicular to the axis of rotation of the shaft, with a first diameter;

wherein the top portion has a substantially circular cross-section, in a plane perpendicular to the axis of rotation of the shaft, with a second diameter larger than the first diameter.

2. The knob of claim 1 wherein the stem has a cylindrical shape.

3. The knob of claim 2, wherein the top portion has a spherical shape.

4. The knob of claim 3, wherein the top portion is a substantially rotationally symmetrical in a plane perpendicular to the axis of rotation of the shaft.

5. The knob of claim 1, wherein the top portion has a spherical shape.

6. The knob of claim 5, wherein the top portion is a substantially rotationally symmetrical in a plane perpendicular to the axis of rotation of the shaft.

7. The knob of claim 1, wherein the top portion is a substantially rotationally symmetrical in a plane perpendicular to the axis of rotation of the shaft.

8. The knob of claim 1, wherein the top portion has protrusions for enhancing grip of the knob by an operator.

9. The knob of claim 8 wherein the stem has a cylindrical shape.

10. The knob of claim 9, wherein the top portion has a spherical shape.

11. The knob of claim 10, wherein the top portion is a substantially rotationally symmetrical in a plane perpendicular to the axis of rotation of the shaft.

12. The knob of claim 8, wherein the top portion has a spherical shape.

13. The knob of claim 12, wherein the top portion is a substantially rotationally symmetrical in a plane perpendicular to the axis of rotation of the shaft.

14. The knob of claim 8, wherein the top portion is a substantially rotationally symmetrical in a plane perpendicular to the axis of rotation of the shaft.

15. A rotary encoder of a control surface for an audio processing system, comprising:

a encoding portion having a shaft and an output providing a signal indicative of rotational movement of the shaft around an axis; and a knob having a stem that engages the shaft of the rotary encoder and extends away from a control surface, and a top portion which an operator manipulates to turn the knob, wherein the stem has a substantially circular cross-section, in a plane perpendicular to the axis of rotation of the shaft, with a first diameter, and wherein the top portion has a substantially circular cross-section, in a plane perpendicular to the axis of rotation of the shaft, with a second diameter larger than the first diameter.

16. The rotary encoder of claim 15, further comprising a display, wherein the display includes a ring of light emitting elements around the knob.

17. The rotary encoder of claim 16 wherein the knob and the shaft are metalized, thereby providing touch sensitivity.

18. The rotary encoder of claim 15 wherein the stem has a cylindrical shape.

19. The rotary encoder of claim 18, wherein the top portion has a spherical shape.

20. The rotary encoder of claim 19, wherein the top portion is a substantially rotationally symmetrical in a plane perpendicular to the axis of rotation of the shaft.

21. The rotary encoder of claim 20, wherein the top portion has protrusions for enhancing grip of the knob by an operator.

22. The rotary encoder of claim 15, wherein the top portion has a spherical shape.

23. The rotary encoder of claim 22, wherein the top portion is a substantially rotationally symmetrical in a plane perpendicular to the axis of rotation of the shaft.

24. The rotary encoder of claim 23, wherein the top portion has protrusions for enhancing grip of the knob by an operator.

25. The rotary encoder of claim 15, wherein the top portion is a substantially rotationally symmetrical in a plane perpendicular to the axis of rotation of the shaft.

26. The rotary encoder of claim 25, wherein the top portion has protrusions for enhancing grip of the knob by an operator.

27. The rotary encoder of claim 15, wherein the top portion has protrusions for enhancing grip of the knob by an operator.

28. An audio processing system, comprising:

a plurality of rows of rotary encoders, wherein each row includes a plurality of rotary encoders, wherein each rotary encoder comprises:

a encoding portion having a shaft and an output providing a signal indicative of rotational movement of the shaft around an axis; and a knob having a stem that engages the shaft of the rotary encoder and extends away from a control surface, and a top portion which an operator manipulates to turn the knob, wherein the stem has a substantially circular cross-section, in a plane perpendicular to the axis of rotation of the shaft, with a first diameter, and wherein the top portion has a substantially circular cross-section, in a plane perpendicular to the axis of rotation of the shaft, with a second diameter larger than the first diameter.

29. The audio processing system of claim 28, further comprising a display, wherein the display includes a ring of light emitting elements around the knob.

30. The audio processing system of claim 29, wherein the knob and the shaft are metalized, thereby providing touch sensitivity.

31. The audio processing system of claim 30 wherein the stem has a cylindrical shape.

32. The audio processing system of claim 31, wherein the top portion has a spherical shape.

33. The audio processing system of claim 32, wherein the top portion is a substantially rotationally symmetrical in a plane perpendicular to the axis of rotation of the shaft.

34. The audio processing system of claim 33, wherein the top portion has protrusions for enhancing grip of the knob by an operator.

* * * * *